US006431075B2

(12) United States Patent
Shim et al.

(10) Patent No.: US 6,431,075 B2
(45) Date of Patent: Aug. 13, 2002

(54) CENTER-CUT METHOD FOR TUNNEL EXCAVATION UTILIZING LARGE UNLOADED BLAST HOLES AND A CIRCULAR PRE-SPLIT

(75) Inventors: Dong Soo Shim, 1019-1406 Mockdong Apt., Shinjeong-1 dong, Yangcheon-gu, Seoul 158-050; Han Uk Lim, Chuncheon; Young Dong Cho, Suwon, all of (KR)

(73) Assignees: Dong Soo Shim; Moojin NeoTech Co., Ltd., both of Seoul (JP)

( * ) Notice: Subject to any disclaimer, the term of this patent is extended or adjusted under 35 U.S.C. 154(b) by 0 days.

(21) Appl. No.: 09/750,842

(22) Filed: Dec. 28, 2000

(30) Foreign Application Priority Data

Dec. 31, 1999 (KR) ..... 99-67903

(51) Int. Cl.[7] ..... F42D 3/00

(52) U.S. Cl. ..... 102/312; 102/313; 102/302; 299/13

(58) Field of Search ..... 102/302, 312, 102/313; 299/13

(56) References Cited

U.S. PATENT DOCUMENTS 4,194,788 A * 3/1980 Miller ..... 299/2
4,353,598 A * 10/1982 Ricketts ..... 299/2
4,396,231 A * 8/1983 Ricketts ..... 299/13
4,440,447 A * 4/1984 Ricketts et al. ..... 102/312 X
4,560,206 A * 12/1985 Ricketts ..... 299/13
4,611,856 A * 9/1986 Cha et al. ..... 299/2
5,634,691 A 6/1997 Kim et al. ..... 299/13
5,650,588 A * 7/1997 Nakajima ..... 102/301
6,014,933 A * 1/2000 Umphries et al. ..... 102/312
6,155,172 A * 12/2000 Nakajima ..... 102/301

* cited by examiner

*Primary Examiner*—Peter A. Nelson
(74) *Attorney, Agent, or Firm*—Sheridan Ross P.C.

(57) ABSTRACT

Disclosed herein is a center-cut blasting method for tunnel excavation. The center-cut blasting method includes the step of drilling a single central center-cut hole at the center of a center-cut region, drilling a plurality of auxiliary center-cut holes comprised of large unloaded auxiliary holes and loaded auxiliary holes that are alternately arranged around the central center-cut hole to be situated in a circle having a predetermined diameter, and drilling a plurality of spreader center-cut holes outside the auxiliary center-cut holes to be situated in concentric circles centered by the central center-cut hole. Thereafter, the center-cut holes are loaded with delay detonators and explosives and the center-cut holes are stemmed with stemming material at their entrances. The loaded auxiliary holes of the auxiliary center-cut holes are blasted so as to create a circular pre-split. After that, the central center-cut hole is blasted so as to create initial dual free surfaces. The spreader center-cut holes are sequentially blasted with a time delay so as to create final dual free surfaces.

9 Claims, 9 Drawing Sheets

– PRIOR ART –

– PRIOR ART –

– PRIOR ART –

– PRIOR ART –

– PRIOR ART –

– PRIOR ART –

– PRIOR ART –

CENTER-CUT METHOD FOR TUNNEL EXCAVATION UTILIZING LARGE UNLOADED BLAST HOLES AND A CIRCULAR PRE-SPLIT

BACKGROUND OF THE INVENTION

1. Field of the Invention

The present invention relates generally to tunnel excavating methods, and more particularly to a center-cut blasting method for tunnel excavation utilizing large unloaded blast holes and a circular pre-split, which employs a pre-splitting technique that blasts loaded auxiliary holes alternately arranged along with large unloaded auxiliary holes in a circle and a sub-drilling technique of rooting away blast holes, thereby facilitating a center-cut operation by weakening the binding force of an original rock and easily achieving dual free surfaces, and shortening the period of execution and reducing execution costs.

2. Description of the Prior Art

Recently, in order to excavate tunnels and underground spaces for underground storage facilities, communication or electrical cable tunnels, waterway tunnels and traffic tunnels, blasting for tunnel excavation is frequently performed.

In general, such tunnel blasting is performed in the following three stages.

With reference to FIG. 1, a first stage of the tunnel blasting is the stage of drilling center-cut holes 1, cut spreader holes 2, floor holes 3 and roof holes 4 to predetermined depths, a second stage is the stage of loading the drilled holes 1, 2, 3 and 4 with detonators and explosives, and a third stage is the stage of detonating the detonators using a triggering device. Referring to FIG. 1, the detonators are detonated from the center-cut holes 1 to the outer holes 2, 3 and 4.

The center-cut holes 1 are loaded with delay detonators in such a way that the detonators are bilaterally symmetrically arranged in the center-cut holes 1 in the order of detonation in an upward direction. The cut spreader holes 2, the floor holes 3 and the roof holes 4 are loaded with delay detonators in such a way that the detonators are arranged in the holes 2, 3 and 4 in the progressing order from the center to the outside. In such a state, the tunnel is blasted by detonating the detonators using a triggering device. The detonations of the detonators are sequentially performed in the progressing order; the center-cut holes 1, the cut spreader holes 2, the floor holes 3 and the roof holes 4.

Tunnel blasting is mostly performed using a single free surface, and generally employs center-cut blasting so as to create new free surfaces.

The center-cut blasting creates dual free surfaces by blasting the center portion of the working face, and is an important factor that governs the success of the entire tunnel blasting.

In FIG. 1, reference characters 1', 2', 3' and 4' designate a center-cut region, a cut spreader region, a floor region and a roof region, respectively.

The "free surface" denotes the surface of rock in contact with an alien sphere, such as air or water. The free surface considerably affects blasting. That is, a blasting effect is in proportion to the number of free surfaces and the degree of proximity of loaded positions to the free surfaces. The reason for this is that resistance is weak in a free surface side and thus blasting energy generates heavy stresses in the free surface side. A "burden" denotes the shortest distance from a free surface to the center of an explosive.

The "center-cut hole" denotes blast holes within a center-cut region of 1.5 to 2.5 m by 1.5 to 2.5 m. A "central center-cut hole" denotes a single loaded blast hole at the center of the center-cut region. "Auxiliary center-cut holes" denote the center-cut holes except for the central center-cut hole arranged around the central center-cut hole in a circle having a predetermined diameter. The auxiliary center-cut holes are comprised of unloaded and loaded auxiliary (blast) holes. "Spreader center-cut holes" denote loaded holes that are arranged in circles around the auxiliary center-cut holes.

As illustrated in FIGS. 2*a* and 2*b*, a conventional tunnel blasting is performed, in such a way that center-cut blast is primarily performed using a cylinder-cut method to obtain dual free surfaces, and the spreader center-cut holes, the cut spreader holes 2, the floor holes 3 and the roof holes 4 are secondly and sequentially blasted.

That is, the conventional tunnel blasting is the blasting in which the spreader center-cut holes, the cut spreader holes 2, the floor holes 3 and the roof holes 4 are sequentially blasted after center-cut blasting is performed by blasting the loaded holes (center-cut holes) each having a diameter of 38 to 45 mm drilled around one to four unloaded holes each having a diameter of 65 to 120 mm.

In the conventional tunnel blasting employing the cylinder-cut method, when center-cut blasting is not sufficiently performed, dual free surfaces are not easily formed during the blasting of the other blast holes, thereby causing many remaining holes to exist. Accordingly, the excavation efficiency is relatively low, that is, about 90% of a drill footage (less than 80%, depending upon the quality of rock). As a result, the advance formed by a single set of blasting is relatively short, so that the number of sets of blasting should be increased.

Because of the problem, there occur problems in which the work period cannot be shortened owing to a long excavation period and a long reinforcement period, excavating costs and drilling costs per blasting set are excessively high, and divisional blasting should be performed to minimize blast vibrations.

In the meantime, conventional center-cut blasting is performed by slant hole center-cut blasting (that is, V-cut blasting) or horizontal center-cut blasting (that is, cylinder-cut blasting; the cylinder-cut blasting is an improvement from burn-cut blasting).

The V-cut blasting is applied where slant center-cut holes are short, outside holes (such as cut spreader holes, floor holes and roof holes) are long, and the drill footages and drill angles of blast holes can vary. The V-cut blasting is chiefly applied to the blasting of short holes in which its advance is less than 2 m. The cylinder-cut blasting is applied where one to four unloaded holes each having a diameter shorter than the diameter of each loaded hole are drilled in parallel with the tunnel axis to the same drill depth as that of the loaded hole. The cylinder-cut blasting is chiefly applied to the blasting of long holes in which its advance is longer than 2 m.

As illustrated in FIGS. 3*a* and 3*b*, the V-cut blasting is performed in such a way that three or four sets of loaded central holes are drilled in the central region of a tunnel in parallel with one another with each set comprised of two opposite loaded central holes, the loaded central holes are simultaneously blasted to create a new free surface, and outer holes are blasted in the order of spreader center-cut holes, cut spreader holes, floor holes and the roof holes to expand the created free surface.

The V-cut blasting is center-cut blasting that has been employed for the longest time. In the V-cut blasting, the bottoms of the drilled center-cut holes are situated in a line with two center-cut holes of each set facing each other, and the interval between two burdens is 100 to 150 mm. Accordingly, the volume of a fractured rock portion is large and the projected area of blasting is wide due to the slant center-cut holes, large fragments are easily formed during center-cut blasting, and the center-cut holes can be drilled in various patterns.

The V-cut blasting is advantageous in that in comparison with the burn-cut and cylinder-cut blasting, the drilling of holes is easy, the drilling footages of holes are short, the flying distance of fracture is short owing to the creation of large fragments, the V-cut blasting is effectively applied to the blasting of short holes or a soft rock, the occurrence of dead pressure may be generated, and a target drill footage can be achieved regardless of inferior drilling due to a large free surface.

However, the V-cut blasting is disadvantageous in that its advance is restricted, a plastic region and extra excavation are increased due to its blast vibrations, the actual drill footages of the holes are short and blasting efficiency is low owing to slant drilling, secondary blasting is required due to the creating of large fragments, and the V-cut blasting is improper for precision rock blasting because of its great vibrations.

In addition, accidents due to falling rocks fall may occur due to the remaining holes, a planed excavation time is lengthened due to the delay of floating rock removal time and next drilling time, and the sectional area of a blasted tunnel is limited owing to slant drilling.

Furthermore, the V-cut blasting has defects in that blasting failure may occur due to the drilling error of V-shaped holes, large fragments may be created due to concentrative loading, and the creation of free surfaces is not easy. The V-cut blasting has a mechanism in which the V-shaped holes are initially blasted and thereafter the other holes are sequentially blasted.

On the other hand, as depicted in FIGS. 4*a* and 4*b*, the horizontal center-cut blasting is applied to the blasting of long holes. Burn-cut blasting and cylinder-cut blasting are generally employed for the horizontal center-cut blasting. In the burn-cut blasting, a plurality of unloaded holes each having the same diameter as that of each loaded hole are drilled. In the cylinder-cut blasting, one to four unloaded holes each having a diameter greater than that of each loaded hole, for example, 65 to 120 mm, are drilled.

In those horizontal center-cut blasting methods, drilled but unloaded holes serve as auxiliary free surfaces (small free surfaces) during the blasting of the loaded holes, so a center-cut operation is facilitated. A free surface F formed after the blasting of the center-cut holes is sequentially expanded to the cut spreader holes, floor holes and roof holes in order.

Accordingly, center-cut holes are drilled perpendicular to the free surface F and in parallel with one another, so that long holes can be drilled and thereby the drill footage each time is longer. The interval between a loaded hole and an unloaded hole is different depending upon the property of the explosive used and the quality of the rock, but generally 10 to 30 cm. The center-cut holes are blasted in a concentrative blasting fashion, or using precise delay detonators.

The horizontal center-cut blasting is advantageous in that its blast vibrations are weak in comparison with the V-cut blasting, the sectional area of a tunnel is not restricted due to horizontal drilling, dead pressure is not generated, and transportation and storage efficiency is superior due to the uniformly sized fractures.

On the other hand, the horizontal center-cut blasting is disadvantageous in that the charge applied to surrounding holes around a burn-hole is large in the case of burn-cut blasting, and blast vibrations may be increased when unloaded holes do not serve as free surfaces due to their small diameters.

In addition, a bit and a rod should be replaced with new ones in order to drill large holes, the remaining holes exist, advanced drilling technique is required to prevent blasting efficiency due to a drilling error, and the flying distance of the smallest fragment is long.

Further, the charge applied to center-cut region is large due to the small fractured volume of the center-cut holes, a working face and surrounding rock portions are damaged, and drilling time is lengthened due to the drilling of large unloaded holes and a plurality of loaded holes around the large unloaded holes.

In the conventional center-cut blasting methods, explosives of the quantity greater than a standard the charge is loaded in the blast holes so as to achieve complete free surfaces in a center-cut region, so that strong vibrations occur owing to the excessive charge per delay, thereby allowing the strong vibrations to damage a mother rock.

Additionally, when the V-cut blasting or cylinder-cut blasting is applied to the center-cut blasting, the remaining holes each having a depth corresponding to 10 to 20% of a drilling footage exist in the center-cut region and the sounding region. In this case, the next blasting should be delayed, so that excavation efficiency is lowered.

In particular, since the considerable portion of a tunnel is blasted in a hard rock region corresponding to Π or ☋ degrees on the basis on the rock mass rating, there is investigated a scheme for improving excavation efficiency by the increase in the advance per blasting set.

In order to overcome the problems of the conventional center-cut blasting methods, a center-cut blasting method for tunnel excavation is developed by introducing pre-splitting technique and sub-drilling technique. In accordance with the pre-splitting technique, a circular pre-split is created by drilling large unloaded holes and loaded holes in a circle and blasting the loaded holes utilizing a detonating fuse and precision explosives, so as to facilitate the achievement of free surfaces. In accordance with the sub-drilling technique, the center-cut holes are drilled additionally but outsides holes except for center-cut holes are not drilled additionally, so as to maximize the advance per blasting set, minimizing the remaining holes and eliminating the sub-drilling of outside holes.

SUMMARY OF THE INVENTION

Accordingly, the present invention has been made keeping in mind the above problems occurring in the prior art, and an object of the present invention is to provide a center-cut blasting method for tunnel excavation utilizing large unloaded blast holes and pre-splitting, in which the binding force of an initial rock is weakened by utilizing large unloaded blast holes and pre-splitting so as to easily form dual free surfaces, thereby facilitating center-cut blasting and thereby improving the efficiency of tunnel blasting.

Another object of the present invention is to provide a center-cut blasting method for tunnel excavation utilizing large unloaded blast holes and pre-splitting in which loaded blast holes and unloaded blast holes are additionally drilled to achieve the maximum advance, thereby shortening the period of tunnel excavation and improving the economical efficiency of tunnel excavation.

In order to accomplish the above object, the present invention provides a center-cut blasting method for tunnel excavation, comprising the steps of: drilling a single central center-cut hole at the center of a center-cut region, drilling a plurality of auxiliary center-cut holes comprised of large unloaded auxiliary holes and loaded auxiliary holes that are alternately arranged around the central center-cut hole to be situated in a circle having a predetermined diameter, and drilling a plurality of spreader center-cut holes outside the auxiliary center-cut holes to be situated in concentric circles centered by the central center-cut hole; loading the center-cut holes with delay detonators and explosives and stemming the center-cut holes with stemming material at their entrances; blasting the loaded auxiliary holes of the auxiliary center-cut holes so as to create a circular pre-split; blasting the central center-cut hole so as to create initial dual free surfaces; and sequentially blasting the spreader center-cut holes with a time delay so as to create final dual free surfaces.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
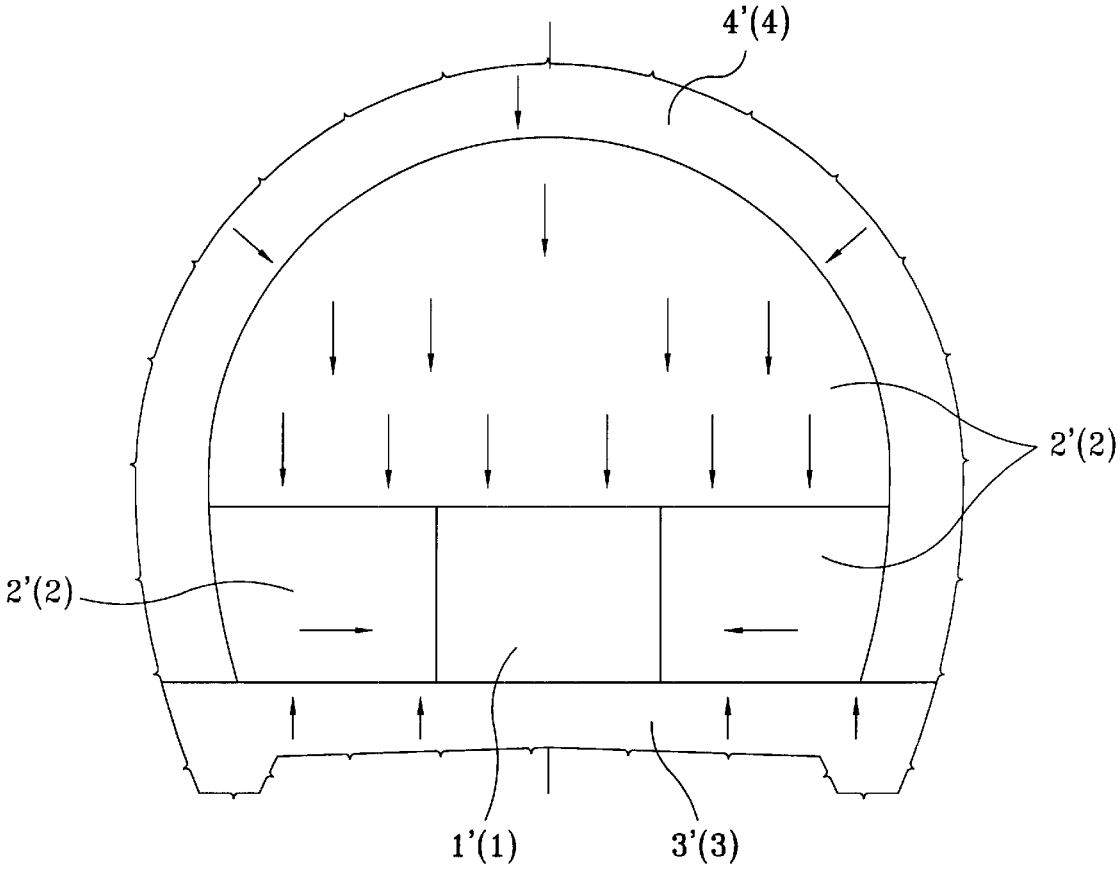
FIG. 1 is a front view showing blasting regions in the case of the full face blasting of a tunnel.
Figure 2A:
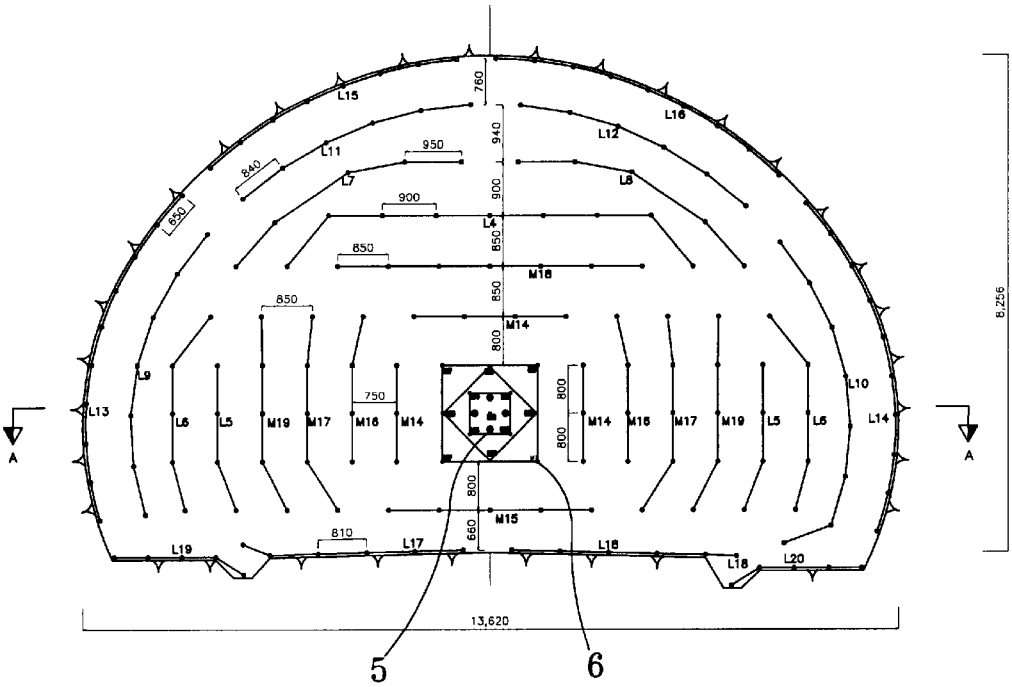
FIG. 2*a* is a diagram showing the full face blasting pattern of a tunnel in accordance with a prior art.
Figure 2B:
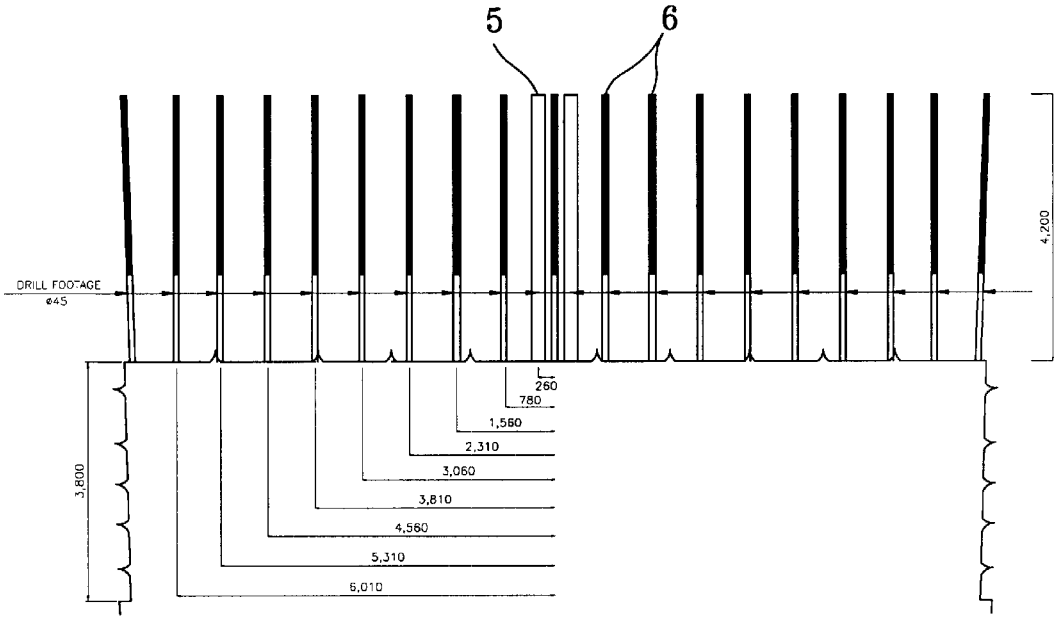
FIG. 2*b* is a cross section taken along line A—A of FIG. 2*a;*
Figure 3A:
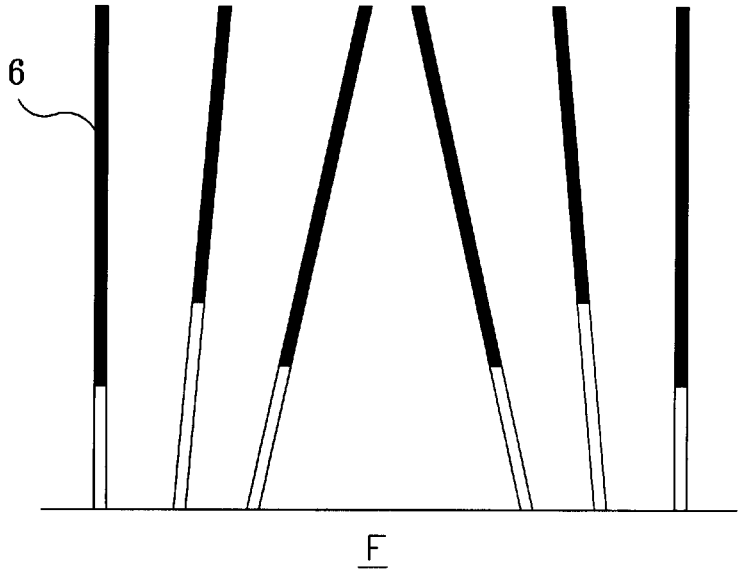
FIG. 3*a* is a cross section showing center-cut holes in accordance with a conventional V-cut blasting technique.
Figure 3B:
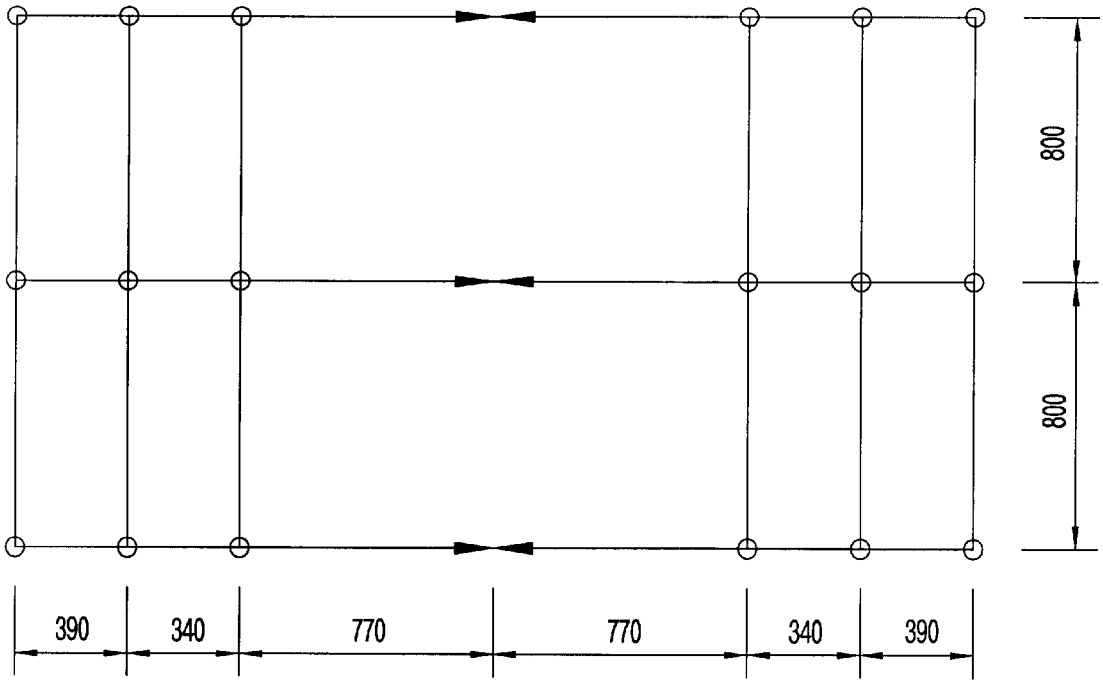
FIG. 3*b* is a diagram showing the drilling pattern corresponding to FIG. 3*a;*
Figure 4A:
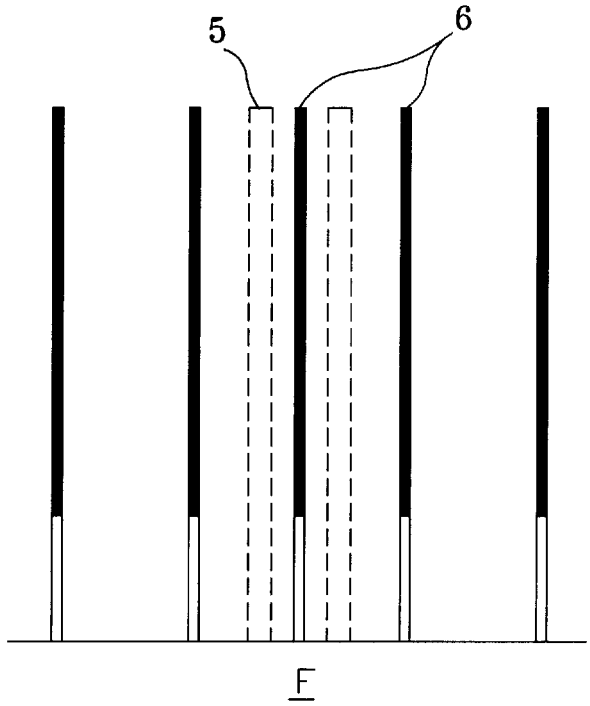
FIG. 4*a* is a cross section showing center-cut holes in accordance with a conventional cylinder-cut blasting technique.
Figure 4B:
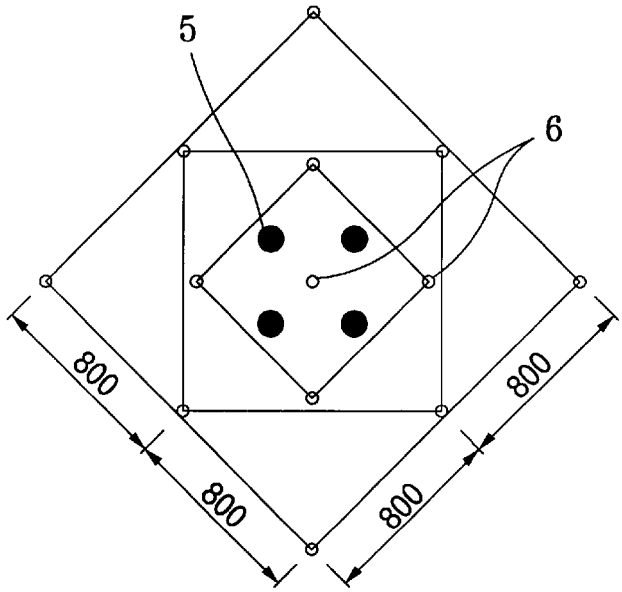
FIG. 4*b* is a diagram showing the drilling pattern corresponding to FIG. 4*a;*

Reference now should be made to the drawings, in which the same reference numerals are used throughout the different drawings to designate the same or similar components.

Figure 6A:
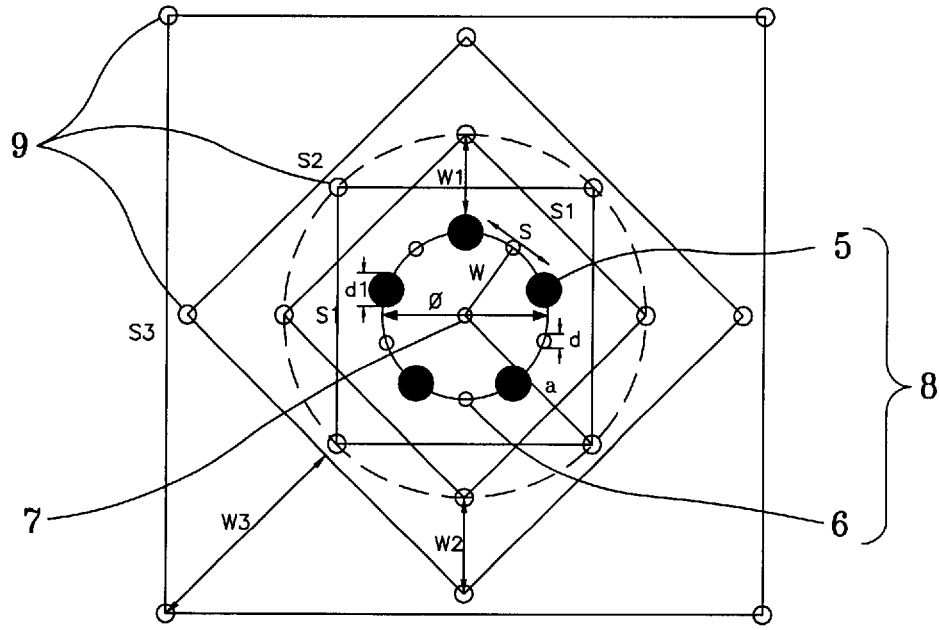
FIG. 6*a* is a diagram showing the drilling pattern for a center-cut region.
Figure 6B:
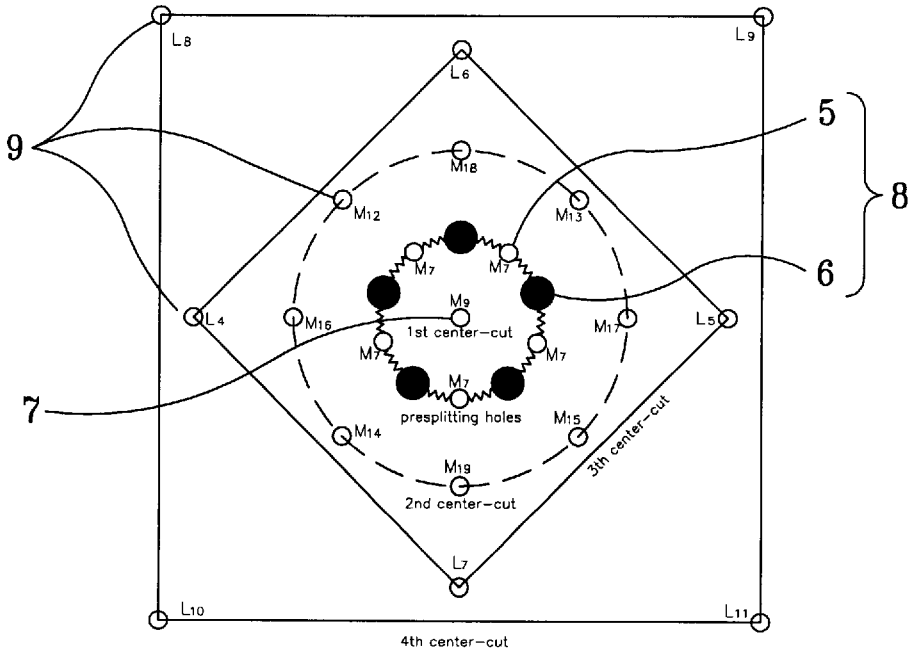
FIG. 6*b* is a diagram showing the principle of a center-cut blasting method in accordance with the present invention.

First of all, the step of drilling a plurality of blast holes in the working face of a tunnel is performed, as depicted in FIG. 6*a*. That is, a single central center-cut hole 7 is drilled in the working face at the center of a center-cut region, five large unloaded auxiliary holes 5 are drilled in the working face to be situated in a circle having a diameter of $\phi$ around the central center-cut hole 7, and five unloaded auxiliary holes 6 are each drilled between one large unloaded auxiliary holes 5 and another (if necessary, the numbers of the unloaded auxiliary holes 5 and the loaded blast auxiliary holes 6 can be increased).

In such a case, the large unloaded auxiliary holes 5 should be situated within a fracture region created by blasting, the large loaded auxiliary holes 5 and the loaded auxiliary holes 6 are drilled perpendicular to a single free surface $F_1$ in the form of cylinder-cuts, and auxiliary center-cut holes 8 comprised of the large loaded auxiliary holes 5 and the loaded auxiliary holes 6 are drilled to be situated in a circle around the central center-cut hole 7.

In the meantime, a plurality of spreader center-cut holes 9 are drilled outside the auxiliary center-cut holes 8 to be situated in concentric circles around the central center-cut hole 7.

In this case, as shown in 6*a*, the positions of the center-cut holes are determined so that the diameter of the circular center-cut region is $\phi$=2W, the radius of the circular center-cut region is W=(4 to 6)d, and the interval between neighboring unloaded auxiliary holes is S+dl×(2 to 3). The drilled depth of each of the unloaded auxiliary holes 5 and the loaded auxiliary holes 6 is drilled to be greater than that of each of the cut spreader holes 2 by (2 to 3)×0.3W, so that sub-drilling for rooting ways the center-cut holes can be achieved and thereby the auxiliary center-cut holes 8 serve as pre-free surfaces $u_1$.

In such a case, W denotes a burden. As shown in FIG. 6*a*, the burden W, the shortest distance from the central center-cut hole 7 to one of the large unloaded auxiliary holes 5 is (4 to 6)×d. The diameter $\phi$ of the circular center-cut region within a first concentric circle is about 450 to 550 mm.

In this description and the drawings, the following definitions are utilized.

$\phi$=2×W, where $\phi$ is the diameter of the circular center-cut region and W is the radius of the circular center-cut region.

W=(4 to 6)×d, where W is the radius of the circular center-cut region and d is the diameter of a loaded hole.

S=(2 to 3)×dl, where S is the shortest distance from one unloaded hole to its neighboring unloaded hole and $d_1$ is the diameter of an unloaded hole.

a=1.1×2W, where "a" is the distance from the central center-cut hole to the second concentric circle and W is the radius of the circular center-cut region.

W1=1.2×W, where W1 is the burden of a second center-cut and W is the radius of the circular center-cut region.

S1=$\sqrt{2}$×a, where S1 is the hole interval of the second center-cut and "a" is the distance from the central center-cut hale to the second concentric circle.

W2=(0.95 to 1.0)×W1, where W2 is the burden of a third center-cut and W1 is the burden of the second center-cut.

S2=$\sqrt{2}$K×W2, where S2 is the hole interval of the third center-cut, K is a burden constant (1.86 to 1.94) and W2 is the burden of the third center-cut.

W3=(2.3 to 2.5)×W2, where W3 is the burden of a fourth center-cut and W2 is the burden of the third center-cut.

S3=$\sqrt{2}$K×W3, where S3 is the hole interval of the fourth center-cut, K is a burden constant (1.86 to 1.94) and W3 is the burden of the fourth center-cut.

Figure 5A:
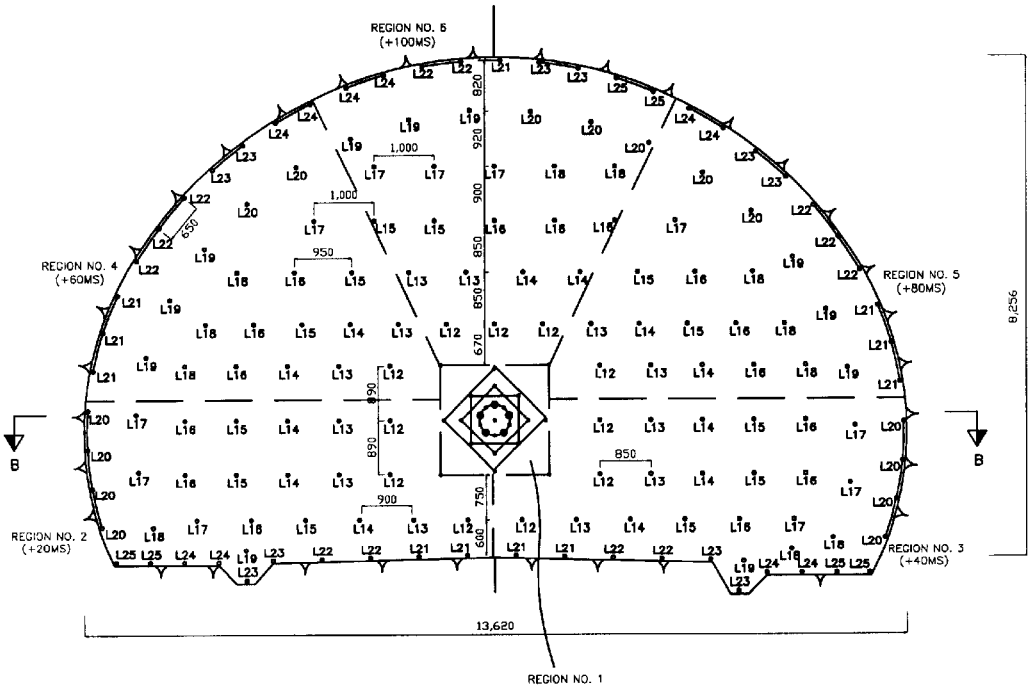
FIG. 5*a* is a diagram showing the full face blasting pattern of a tunnel in accordance with the present invention.
Figure 5B:
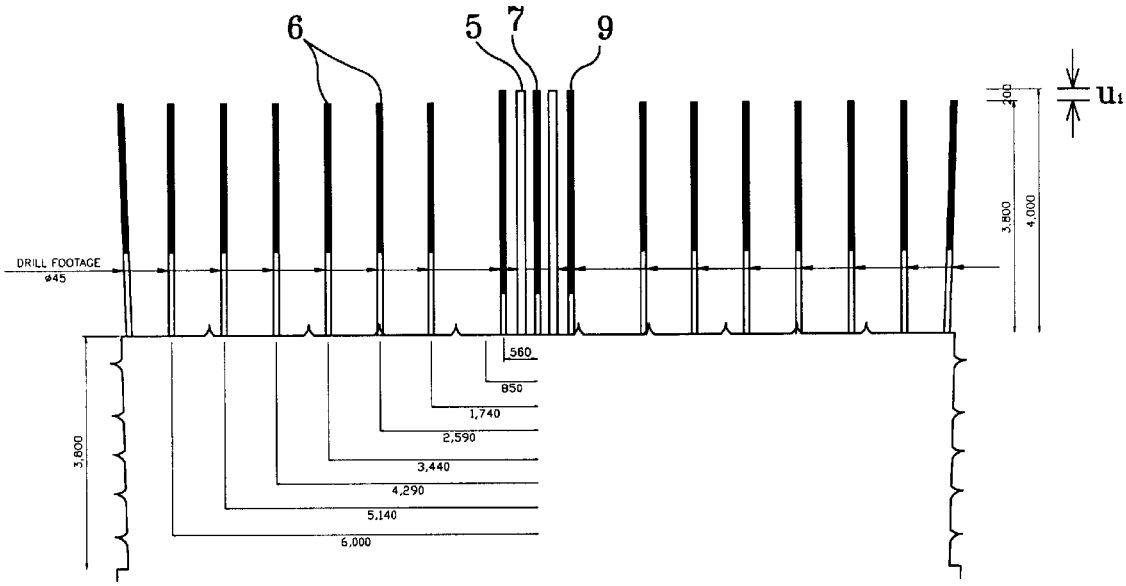
FIG. 5*b* is a cross section taken along line B—B of FIG. 5*a;*

The drill intervals and drill depths of cut spreader holes 2, the floor holes 3 and the roof holes 4 except the central center-cut hole 1 are determined depending upon the condition of the rock and blasting conditions, which are performed similarly to the conventional cylinder-cut method in principle. The blast holes are arranged as illustrated in FIGS. 5*a* and 5*b* and are drilled as indicated in the following table 1.

TABLE 1

Drilling and loading conditions for prior art and present invention

| Kind of art<br>Kind of rock | Prior art<br>Hard rock | Present invention<br>Hard rock |
|---|---|---|
| Cross sectional area ($m^2$) | 87.775 | 87.775 |
| Drill footage (m) | | |
| Central center-cut | 4.2 | 4.0 |
| Outer hole | 4.2 | 4.0 |
| Advance (m) | 3.8 | 3.8 |
| Number of holes | | |
| Unloaded holes | 4 | 5 |
| Loaded holes | 186 | 181 |
| Total charge (kg) | 454.2 | 432.5 |
| Specific charge (kg) | 1.362 | 1.297 |
| Maximum charge per delay (kg/delay) | 26.25 | 26.25 |

After the step of drilling a plurality of blast holes in the working face of a tunnel, the step of loading the blast holes with explosives is performed. Attention should be paid to the loading of the central center-cut hole 7 and auxiliary center-cut holes 8. The loading of the other blast holes except the central center-cut hole 7 and auxiliary center-cut holes 8 is the same as in the burn-cut and cylinder-cut methods in principle.

The loading of the auxiliary center-cut holes 8 for creating a pre-split can be performed in two ways as indicated in the following table 3.

Figure 7A:
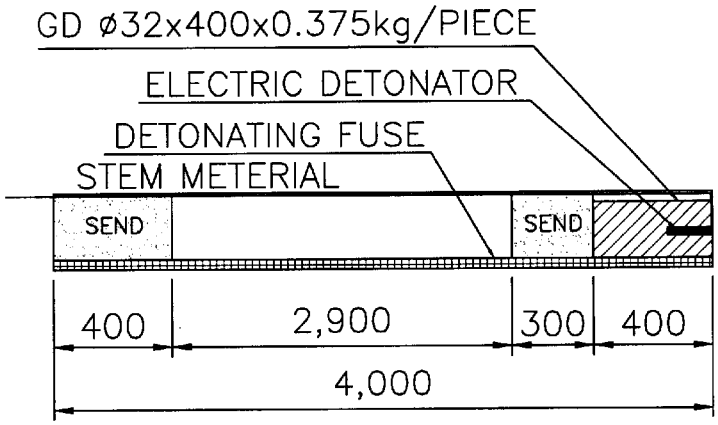
FIG. 7*a* is a view showing a state in which an auxiliary center-cut hole is loaded in accordance with a first embodiment of the present invention.

First, as shown in FIG. 7*a,* the inner portion of a blast hole is loaded with dynamite GD of 0.375 kg, and a detonating fuse of 40 g/m is connected to the dynamite with its outer end situated out of the hole. In order to filly utilize the power of the explosives, full stemming is performed at two positions, respectively in lengths of 300 mm and 400 mm. In this case, the reason for the utilization of the detonating fuse is to create a pre-splitting effect by underloading.

Figure 7B:
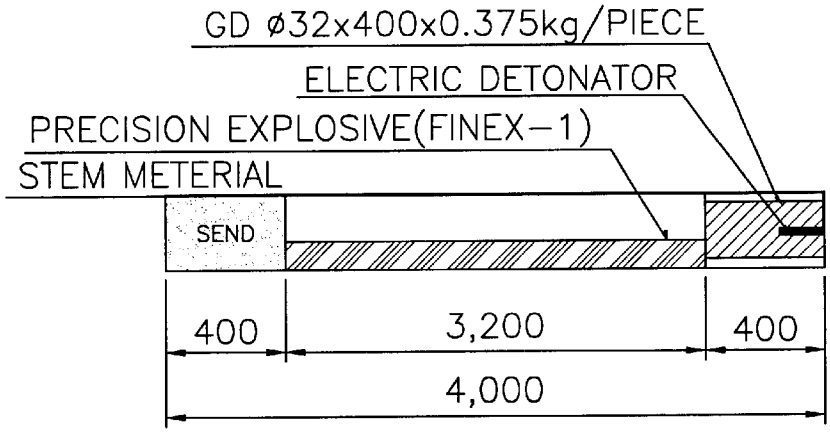
FIG. 7*b* is a view showing a state in which an auxiliary center-cut hole is loaded in accordance with a second embodiment of the present invention.

Second, as shown in FIG. 7*b,* a precision explosive (such as Finex-1) having a low specific gravity and a low detonation velocity is employed instead of the detonating fuse. This method has been employed in controlled blasting so as to prevent the damage of a mother rock and extra excavation, and serves to maximize a pre-splitting effect by providing a decoupling effect to center-cut holes.

Figure 7C:
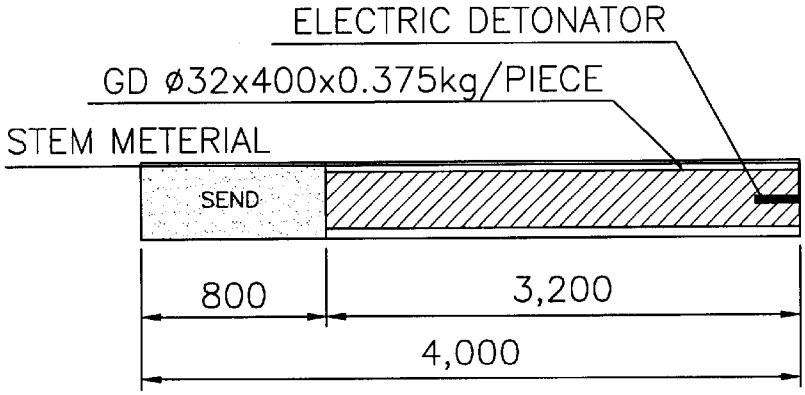
FIG. 7*c* is a view showing a state in which a central center-cut hole is loaded in accordance with the first embodiment of the present invention.

Though the loading of the central center-cut hole 7 is different depending upon the conditions of the rock, the standard example of the loading is described in the following table 3. That is, as shown in FIG. 7*c,* 70 to 80% of the drill footage is loaded with the explosives such as gelatin dynamite and 20 to 30% are fully stemmed.

The reason for loading the central center-cut hole 6 in a standard loading fashion is to obtain such explosives as to fracture and move the pre-split region created in the previous stage.

TABLE 2

Specification of full-face charges in accordance with prior art

| Kind | Number of holes | Charge per hole (kg) | Total charge (kg) | Remark |
|---|---|---|---|---|
| Unloaded hole | 4 | — | — | Gelatin dynamite explosive: ϕ 32 m/m × 400 m/m × 375 g |
| Center-hole | 13 | 3.0 | 39.0 | Precision explosive: |
| Spreader cut hole | 114 | 2.625 | 299.25 | ϕ 17 m/m × 425 m/m × 100 g |
| Roof hole | 37 | 1.35 | 49.95 | |
| Floor hole | 22 | 3.00 | 66.0 | |
| Total | 190 | — | 454.2 | |

TABLE 3

Specification of full-face charges in accordance with present invention

| Kind | Number of holes | Charge per hole (kg) | | Total charge (kg) | | Remark |
|---|---|---|---|---|---|---|
| Unloaded auxiliary hole | 5 | — | | — | | Gelatin dynamite explosive: ϕ 32 m/m × 400 m/m × 375 g |
| Loaded auxiliary hole | 5 | Dynamite 0.315 | Detonating fuse 0.16 | Dynamite 1.875 | Detonating fuse 0.8 | Precision explosive: ϕ 17 m/m × 425 m/m × 100 g |
| Central center-hole | 1 | 3.375 | | 3.375 | | Detonating fuse: 40 g/m |
| Spreader center-hole | 16 | 3.0 | | 48.0 | | |
| Spreader cut hole | 100 | 2.625 | | 262.5 | | |
| Roof hole | 37 | 1.35 | | 49.95 | | |
| Floor hole | 22 | 3.00 | | 66.0 | | |
| Total | 186 | — | | 432.5 | | |

The setting of the delays in the detonators is one of principal factors that govern the success of center-cut blasting. The explosives loaded in the loaded auxiliary holes 6 that are initially detonated to create a pre-split are simultaneously blasted, whereas the explosives loaded in the central center-cut hole 7 and the second, third and fourth spreader center-cut holes are detonated using electric delay detonators having time delay ranging from 20 ms to 100 ms.

Hereinafter, the process of creating the dual free surfaces $F_1$ and $F_2$ according to the center-cut blasting method of the present invention is described.

The reason why the detonation time delay, as described above, is set to be within a range of 20 to 100 ms is that a time delay sufficient for a portion of the rock to be fractured and moved can be provided.

It is proved that the fractured rock is moved at a speed of 40 to 60 m/s when explosives loaded in the central center-cut hole 7 have been detonated after explosives loaded in the loaded auxiliary holes 6 are detonated to create a circular pre-split. Accordingly, in order to completely blast away the center-cut region in which the blast holes are drilled in a depth of 4 m, the time delay between the central center-cut hole and the loaded auxiliary holes preferably is 40 ms.

After the explosives loaded in the central center-cut hole are detonated, first spreader center-cut holes 9 are detonated with a time delay of 60 ms so as to provide the time for the fracture and movement of the rock sufficient to create the dual free surfaces $F_1$ and $F_2$.

The explosives loaded in the second and third spreader center-cut holes 9 are detonated using delay detonators having a time delay of 20 to 100 ms, so that the center-cut region is completely rooted out, thereby creating the dual free surfaces $F_1$ and $F_2$.

That is, when the loaded auxiliary holes 6 are blasted, a circular pre-split is created. When the central center-cut hole 7 situated at the center of a pre-split region is blasted with a predetermined time delay, the dual free surfaces $F_1$ and $F_2$ are created by the combined operation of the large unloaded auxiliary holes 5 and the loaded auxiliary holes 6. Thereafter, as the spreader center-cut holes 9 are sequentially blasted, one of the dual free surfaces $F_2$ is expanded to form a large hole having a diameter of 450 to 550 mm, thereby achieving the same effect as that achieved when the free surface is formed by boring.

Figure 8A:
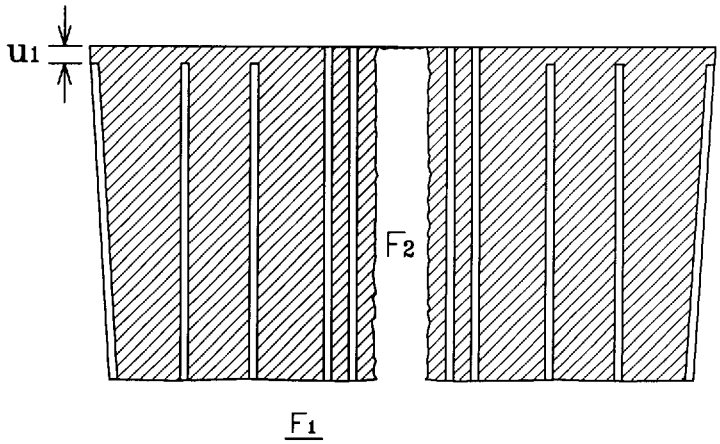
FIGS. 8*a* to 8*e* are views showing the stages in which the full face of a tunnel is blasted in due order.
Figure 8B:
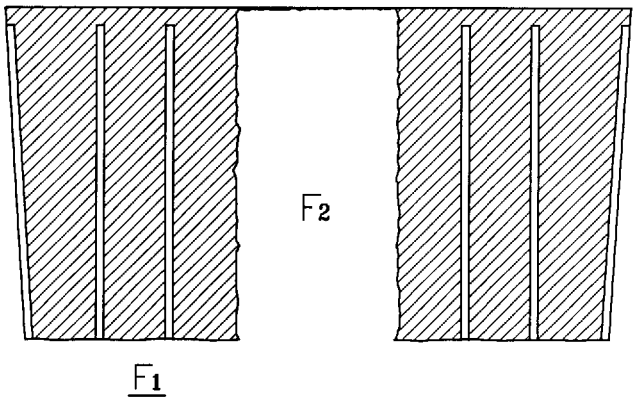

As the spreader center-cut holes 9 are blasted, one of the dual free surfaces $F_2$ is expanded. At this time, the size of the center-cut region is 1.5 to 2.5 m by 1.5 to 2.5 m. As apparent from FIG. 8*b,* one of the dual free surfaces $F_2$ is distinctly expanded.

Figure 8C:
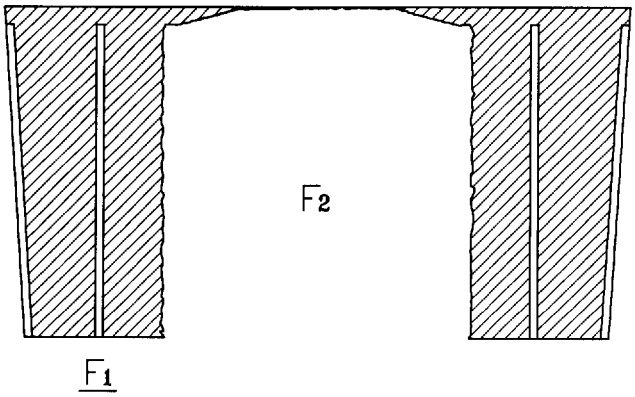
Figure 8D:
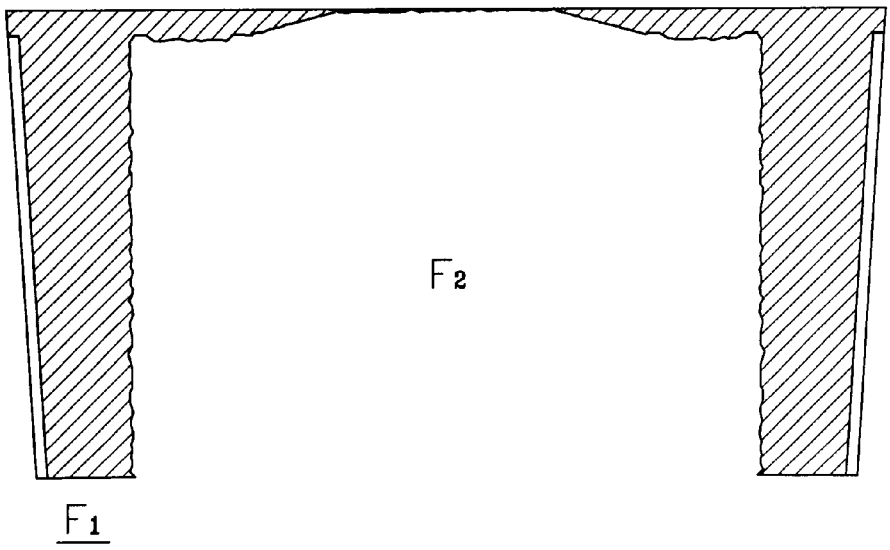
Figure 8E:
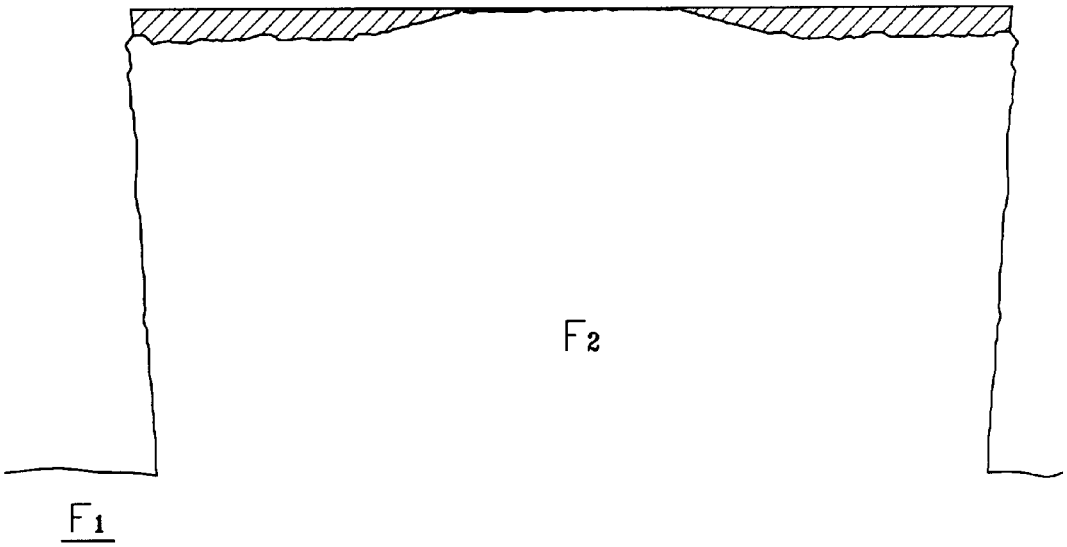

Thereafter, the charges and detonating time delays of the cut spreader holes 2, the floor holes 3 and the roof holes 4 are determined in accordance with the same principle as that of the cylinder-cut method. The cut spreader holes 2, the floor holes 3 and the roof holes 4 are blasted in the blasting order indicated in the following table 4 while one of the dual free surfaces F2 is expanded in the progressing order from FIG. 8*c* to FIG. 8*e*.

These detonating methods may be classified into a non-multistage detonating method and a multistage detonating method. The non-multistage detonating method is a detonating method utilizing conventional electric detonators, while the multistage detonating method is a detonating method utilizing a multistage blasting apparatus. The multistage detonating method can control blast vibrations and minimize the damage of an original rock. These two detonating methods can be applied to the center-cut blasting method of the present invention.

In this embodiment, the blast holes are loaded with the explosives as indicated in table 3 and blasted in a multistage blasting fashion. The working face is divided into six regions. An auxiliary detonator wire No. 1, an auxiliary detonator wire No. 1, an auxiliary detonator wire No. 2, an auxiliary detonator wire No. 3, an auxiliary detonator wire No. 4, an auxiliary detonator wire No. 5, and an auxiliary detonator wire No. 6 are connected at their first ends to the center-cut region, a lower left region, a lower right region, an upper left region, an upper right region and an upper center region, respectively, and are connected at their second ends to a multistage blasting apparatus.

A time delay for each wire is set at 20 ms, and the detonating time delays are indicated in the following table 4 in detail.

In the multistage detonating apparatus, when the time delay is set at 20 ms and six wires are utilized, the time period until electricity is applied to the sixth wire is 100 ms. Accordingly, in the center-cut blasting method of the present invention, an initially detonated detonator should be detonated after a time period of 100 ms so as to prevent cutoff.

Ten auxiliary detonator wires can be connected to the multistage detonating apparatus. However, in these tests, six auxiliary detonator wires were connected to six regions by which total one hundred and eighty one holes were divided. In consideration of the time period for which electricity is applied to the sixth wire, an initially detonated detonator should have the time delay greater than the time period for which electricity is applied to the sixth wire. In these tests, 140 ms (MS No. 7) was employed as the initially detonated detonator.

In the tunnel blasting employing the center-cut blasting method of the present invention, the central center-cut hole 1 is completely blasted to achieve the dual free surfaces $F_1$ and $F_2$ and thereafter the cut spreader holes 2, the floor holes 3 and the roof holes 4 are sequentially blasted with a time difference set by region, as shown in FIGS. 8*a* to 8*e*.

TABLE 4

| | | Time delays for detonation (set time delay: 20 ms) | | | | | | | |
|---|---|---|---|---|---|---|---|---|---|
| Wire No. | | 1 (0 ms) | 2 (20 ms) | 3 (40 ms) | 4 (60 ms) | 5 (80 ms) | 6 (100 ms) | Remark 1 (number of total detonators) | Remark 2 |
| M | 7 | 140(5) | | | | | | 5 | Center-cut |
| S | 9 | 180(1) | | | | | | 1 | region |
| | 12 | 240(1) | | | | | | 1 | (twenty two |
| | 13 | 260(1) | | | | | | 1 | holes) |
| | 14 | 260(1) | | | | | | 1 | |
| | 15 | 260(1) | | | | | | 1 | |
| | 16 | 320(1) | | | | | | 1 | |
| | 17 | 340(1) | | | | | | 1 | |
| | 18 | 360(1) | | | | | | 1 | |
| | 19 | 380(1) | | | | | | 1 | |
| L | 4 | 400(1) | | | | | | 1 | |
| P | 5 | 500(1) | | | | | | 1 | |
| | 6 | 600(1) | | | | | | 1 | |
| | 7 | 700(1) | | | | | | 1 | |
| | 8 | 800(1) | | | | | | 1 | |
| | 9 | 900(1) | | | | | | 1 | |
| | 10 | 1000(1) | | | | | | 1 | |
| | 11 | 1200(1) | | | | | | 1 | |
| | 12 | | 1420(3) | 1440(3) | 1460(1) | 1480(1) | 1500(3) | 11 | Outside region |
| | 13 | | 1620(3) | 1640(3) | 1660(2) | 1680(2) | 1700(2) | 12 | (one hundred |
| | 14 | | 1820(3) | 1840(3) | 1860(2) | 1880(2) | 1900(2) | 12 | fifty nine holes) |
| | 15 | | 2020(3) | 2040(3) | 2060(2) | 2080(2) | 2100(2) | 12 | |

TABLE 4-continued

| Wire No. | 1 (0 ms) | 2 (20 ms) | 3 (40 ms) | 4 (60 ms) | 5 (80 ms) | 6 (100 ms) | Remark 1 (number of total detonators) | Remark 2 |
|---|---|---|---|---|---|---|---|---|
| | Time delays for detonation (set time delay: 20 ms) | | | | | | | |
| 16 | | 2520(3) | 2540(3) | 2560(3) | 2580(3) | 2600(3) | 15 | |
| 17 | | 3020(3) | 3040(3) | 3060(1) | 3080(1) | 3100(3) | 11 | |
| 18 | | 3520(1) | 3540(2) | 3560(3) | 3580(3) | 3600(2) | 11 | |
| 19 | | 4020(1) | 4040(1) | 4060(3) | 4080(3) | 4100(3) | 11 | |
| 20 | | 4520(4) | 4540(4) | 4560(2) | 4580(2) | 4600(3) | 15 | |
| 21 | | 5020(2) | 5040(2) | 5060(3) | 5080(3) | 5100(1) | 11 | |
| 22 | | 5520(2) | 5540(2) | 5560(3) | 5580(2) | 5600(2) | 12 | |
| 23 | | 6020(2) | 6040(2) | 6060(2) | 6080(2) | 6100(2) | 10 | |
| 24 | | 6520(2) | 6540(2) | 6560(2) | 6580(2) | 6600(2) | 10 | |
| 23 | | 7020(2) | 7040(2) | | | 7100(2) | 6 | |
| Total | | | | | | | 181 | |

*() denotes the number of detonators.

One of the principal characteristics of this center-cut blasting method is to achieve a pre-splitting effect. So far, pre-splitting blasting has been utilized so as to control blast vibrations and prevent the enlargement of a damaged area.

The center-cut blasting method of the present invention is characterized in that a center region is blasted in an under-loading fashion to create a pre-split in the rock so as to achieve a large-scale center cut having effective free surfaces $F_1$ and $F_2$, thereby improving the fracture effect by the blasting of the central center-cut hole 7. In brief, the center-cut blast of the present invention is characterized in that a large hole having the dual free surfaces $F_1$ and $F_2$.

Since the center-cut blasting method of the present invention achieves an advance of about 98% of a drill footage, (the advance/the drill footage) is approximately on a par except for the center-cut region. The center-cut hole 1 is drilled to a depth 20 to 30 cm greater than the cut spreader holes 2.

As a result, in accordance with the center-cut blasting method of the present invention, the combined effects of the pre-split in the center-cut region, the unloaded auxiliary holes 5 and the loaded auxiliary holes 6 allow the center-cut region to be blasted without remaining holes. Since the charge per hole is little in comparison with the prior art, side effects do not occur.

Accordingly, since one of the initial dual free surfaces $F_2$ is completely created by the sub-drilling of the center-cut region and the other loaded blast holes are blasted to expand one of the dual free surfaces $F_2$, so that the excavating effect is considerably improved. If necessary, the damage of the surrounding portions of the rock can be considerably reduced by controlled blasting. Since high excavation efficiency can be achieved by the sub-drilling of 5 to 10% without the sub-drilling of the cut spreader holes 2, the floor holes 3 and the roof holes 4, effective blasting can be performed.

A test blasting according to the present invention and another test blasting according to the prior art were performed under the same rock conditions and with the same tunnel size so as to compare the tunnel blasting of the present invention with the tunnel blasting of the prior art in technical efficiency, the facility of execution and economical efficiency. The test results are compared with respect to excavation efficiency, specific charge, excavating time, flying distance of rock fragments and the sizes of the rock fragment in the following table 5.

TABLE 5

Comparison of test blasting of prior art and test blasting of present invention

| Item | Prior art | Present invention |
|---|---|---|
| Drilling efficiency | 90 to 95% | 98 to 100% |
| Mean flying distance of fragments (m) | 63.5 | 48.63 |
| Mean depth of remaining holes (cm) | 30.0 | 2.0 |
| Total drilling footage (m) | 798 | 712.2 |
| Reduction ratio of drilling footage (on the basis of conventional type, %), | 10.75% (85.8 m reduced) | |
| Drilling time (on the basis of three-boom jumbo drill, minute) | 223.30 (¤ 3 hours and 43 minutes) | 206.38 (¤ 3 hours and 26 minutes) |
| Reduction ratio of drilling time (on the basis of conventional type, %) | 7.58% (16.92 reduced) | |

With respect to drilling efficiency, the tunnel blasting of the present invention achieves an efficiency of 98 to 100%, and achieves high efficiency in comparison with the prior art. The reason for this high efficiency is that the binding force of an original rock is weakened by circular pre-splitting blasting in a first stage to allow one of the initial dual free surfaces $F_2$ to be easily formed, so that a center cut having a large diameter of 450 to 550 mm is formed by the center-cut blasting method and complete blasting is performed to cause the depth of the remaining holes to be less than 2 cm.

The specific charge denotes the quantity of explosives consumed per unit volume of the rock. As the specific charge is less, the quantity of explosives consumed to blast the rock is reduced. The specific charge for the present invention is 1.297 kg/m$^2$, and so the specific charge for the present invention is less than the specific charge for the prior art. In accordance with the present invention, blasting costs are reduced by a reduction in the quantity of explosives consumed, so that the blasting method of the present invention can be regarded as an economical blasting method.

In the blasting of the present invention, the specific charge generally is less in comparison with the conventional blasting, so that the blasting method of the present invention can be regarded as an efficient and economical blasting method. The reason for this is that the binding force of the original rock is weakened by the operation of the auxiliary center-cut holes 8 to facilitate the creation of the dual free surfaces $F_1$ and $F_2$ and thereby the dual free surfaces $F_1$ and $F_2$ are created by the blasting of the central center-cut hole 1, so that the cut spreader holes 2, the floor holes 3 and the roof holes 4 can be blasted with a small quantity of explosives.

TABLE 6

Comparison of drilling times (on the basis of three boom jumbo drill)

| | Prior art | | | | Present invention | | | |
|---|---|---|---|---|---|---|---|---|
| Kind | Number of holes | Drill footage (m) | Drilling time per hole (minute) | Total drilling time (minute) | Number of holes | Drill footage (m) | Drilling time per hole (minute) | Total drilling time (minute) |
| Unloaded hole | 4 | 4.2 | 21 | 84 | 5 | 4.0 | 20 | 100 |
| Center-cut hole | 13 | 4.2 | 3.15 | 40.35 | 22 | 4.0 | 3 | 66 |
| Cut spreader hole, floor hole, roof hole | 173 | 4.2 | 3.15 | 544.95 | 159 | 3.8 | 2.85 | 453.15 |
| Total | 190 | | | 669.9 | 186 | | | 619.15 |
| Actual drilling time | | | | 223.3 | | | | 206.38 |

The blasting of the present invention requires a short drilling time in comparison with the blasting of the prior art. The drilling time for the blasting of the present invention is shorter than the drilling time for the blasting of the prior art by about 17 minutes. The reason for this is that in the blasting of the prior art the drill footages of the cut spreader holes 2, the floor holes 3 and the roof holes 4 are the same as the drill footages of the center-cut holes so as to achieve a target advance.

On the other hand, in the blasting of the present invention, since the target advance can be achieved by drilling only each of the center-cut holes to a depth 5 to 10% longer than the target advance (this additional depth is designated by $u_1$), the additional time for which the cut spreader holes 2, the floor holes 3 and the roof holes 4 are additionally drilled can be saved, thereby reducing the drilling time for the blasting of the present invention in comparison with the blasting of the prior art.

The flying distance denotes the maximum distance a fragment flies from the working face. The flying distance for the blasting of the present invention is also shorter in comparison with the blasting of the prior art. Since a ventilation duct, an electric panel and a drilling water pipe can be situated near the working face owing to this short flying distance, working time can be saved.

TABLE 7

Comparison of fragment sizes

| Kind | Prior art | Present invention |
|---|---|---|
| Size of fragment | | |
| Less than 50 cm | 60% | 70% |
| 50 to 80 cm | 40% | 30% |

With regard to the fragment sizes, the blasting of the present invention allows the rock to be fractured so as to easily achieve the dual free surfaces $F_1$ and $F_2$, thereby fracturing the rock into fragments each having a small size.

In general, principal factors affecting the quantity of blast vibrations are the maximum charge per delay and a distance to a blast source. Of these factors, a blasting operation is restricted by the maximum charge per delay that can be controlled.

In the tunnel blasting, the greatest vibrations are generally created by the center-cut blasting. In accordance with the center-cut blasting method of the present invention, since the binding force of the original rock is considerably weakened by the creation of the circular pre-split and the center-cut blasting is easily performed to achieve the dual free surfaces $F_1$ and $F_2$, so the blast vibrations during center-cut blasting is considerably decreased. Additionally, the blasting of the cut spreader holes 2, the floor holes 3 and the roof holes are easily blasted utilizing complete dual free surfaces $F_1$ and $F_2$, thereby also reducing the blast vibrations.

Meanwhile, in accordance with the center-cut blasting method of the present invention, the binding force of the original rock in the center-cut region is weakened by the application of pre-splitting blasting and sub-drilling to facilitate the creation of the dual free surfaces $F_1$ and $F_2$ and the blasting of the cut spreader holes 2 can be effectively performed utilizing the dual free surfaces $F_1$ and $F_2$, so that the excavation effect can be maximized.

Accordingly, the sub-drilling of the cut spreader holes 2, the floor holes 3 and the roof holes 4 is not required, and the advance per blasting set can be improved by effective center-cut blasting in comparison with the conventional center-cut blasting. Additionally, if necessary, the center-cut blasting can be performed utilizing a multistage blasting apparatus, thereby minimizing the damage of a mother rock, reducing blast pollution (such as noise pollution and vibration pollution) and preventing flying fragments.

As apparent from the test results, the center-cut blasting method of the present invention has advantages with respect to technical efficiency, economical efficiency and safety.

The center-cut blasting method of the present invention can be effectively applied to the blasting of long holes in the unsupported region of a tunnel, that is, the blasting of a hard rock in the center portion of tunnel. The advance per blasting set can be lengthened in comparison with the conventional blasting. If the center-cut blasting method of the present invention is utilized in combination with multistage blasting method, the damage of the mother rock can be minimized and superior effects can be achieved with respect to blast vibrations, blast noise, fragment sizes and flying fragments in the comparison with the conventional blasting methods.

Additionally, since the free surface $F_2$ is easily created by weakening the binding force of an original rock by means of the creation of a circular pre-split and the advance corresponding to the drill footage can be achieved, so the excavation efficiency is maximized, operation can be performed safely and protection for a mother rock can be secured, thereby creating advantages with respect to quality control and safety.

As a result, in accordance with the present invention, the binding force of an original rock is weakened by circular pre-splitting using large unloaded auxiliary holes and loaded auxiliary holes arranged in a circle, so that dual free surfaces $F_1$ and $F_2$ can be easily achieved, thereby facilitating center-cut blasting. The advance per blasting set can be lengthened in comparison with a conventional blasting by horizontal drilling and thus excavation efficiency is increased, thereby improving working efficiency.

In addition, complete dual free surfaces are created by the sub-drilling of the large unloaded auxiliary holes and the loaded auxiliary holes, so that the maximum advance per blasting set can be achieved and the free surface $F_2$ can be easily achieved. Consequently, the sub-drilling of the outside holes are not required to obtain sufficient drilling footages differently from a conventional blasting method and the remaining holes do not exist, so that the working period is shortened and blasting costs are reduced, thus improving economical efficiency.

V-cut and cylinder-cut methods are not utilized at the same time to blast long holes, blast holes can be easily drilled without a skilled worker, blast vibrations are reduced in comparison with the V-cut and cylinder-cut methods, the size to which center-cut blasting can be applied is not restricted and a working face and surrounding rock portions are not seriously damaged.

In brief, the center-cut blasting method for tunnel excavation in accordance with the present invention has advantages with respect to the facility of execution, economical efficiency and safety.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A center-cut blasting method for tunnel excavation, comprising the steps of:

drilling a single central center-cut hole at the center of a center-cut region, drilling a plurality of auxiliary center-cut holes comprised of large unloaded auxiliary holes and loaded auxiliary holes that are alternately arranged around said central center-cut hole to be situated in a circle having a predetermined diameter, and drilling a plurality of spreader center-cut holes outside said auxiliary center-cut holes to be situated in concentric circles centered by said central center-cut hole;

loading said center-cut holes with delay detonators and explosives and stemming said center-cut holes with stemming material at their entrances;

blasting the loaded auxiliary holes of said auxiliary center-cut holes so as to create a circular pre-split;

blasting said central center-cut hole so as to create initial dual free surfaces; and sequentially blasting said spreader center-cut holes with a time delay so as to create final dual free surfaces.

2. The center-cut blasting method according to claim 1, wherein each of the drill footages of said large unloaded auxiliary holes and said loaded auxiliary holes is longer than each of the drill footages of said cut spreader holes, said floor holes and said roof holes by 20 to 30 cm.

3. The center-cut blasting method according to claim 2, wherein the diameter of each of said large unloaded auxiliary holes is 65 to 120 cm.

4. The center-cut blasting method according to any of claims 1, wherein each of said auxiliary center-cut holes is drilled in the form of a V-cut to be perpendicular to a working face.

5. The center-cut blasting method according to claim 1, wherein said auxiliary center-cut holes are simultaneously blasted to form a pre-split.

6. The center-cut blasting method according to claim 1, wherein said auxiliary center-cut holes are blasted in an underloading fashion.

7. The center-cut blasting method according to claim 1, wherein said spreader center-cut holes are blasted using delay detonators having a time delay of 20 to 100 ms.

8. The center-cut blasting method according to claim 1, wherein the region blasted by the blasting of said auxiliary center-cut holes and said central center-cut hole is a large hole having a diameter of 450 to 550 mm.

9. The center-cut blasting method according to claim 1, wherein the size of said center-cut region is 1.5 to 2.5 m by 1.5 to 2.5 m.

* * * * *

UNITED STATES PATENT AND TRADEMARK OFFICE

CERTIFICATE OF CORRECTION

PATENT NO. : 6,431,075 B2
DATED : August 13, 2002
INVENTOR(S) : Dong Soo Shim et al.

It is certified that error appears in the above-identified patent and that said Letters Patent is hereby corrected as shown below:

Title page,
Insert -- Item [73] Assignees: Dong Soo Shim; Moojin NeoTech Co., Ltd., both of Seoul (KR) --

Signed and Sealed this

Thirty-first Day of December, 2002

JAMES E. ROGAN
*Director of the United States Patent and Trademark Office*